US011480180B2

(12) United States Patent
Li et al.

(10) Patent No.: US 11,480,180 B2
(45) Date of Patent: Oct. 25, 2022

(54) SELF-PRIMING STARTING DEVICE FOR CENTRIFUGAL PUMP

(71) Applicant: JIANGSU UNIVERSITY, Zhenjiang (CN)

(72) Inventors: Wei Li, Zhenjiang (CN); Hao Chang, Zhenjiang (CN); Weidong Shi, Zhenjiang (CN); Ling Zhou, Zhenjiang (CN); Weidong Cao, Zhenjiang (CN); Yong Zhu, Zhenjiang (CN); Tao Lang, Zhenjiang (CN); Yangyang Wei, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 17/598,287

(22) PCT Filed: Dec. 20, 2019

(86) PCT No.: PCT/CN2019/126818
§ 371 (c)(1),
(2) Date: Sep. 26, 2021

(87) PCT Pub. No.: WO2021/012600
PCT Pub. Date: Jan. 28, 2021

(65) Prior Publication Data

US 2022/0120280 A1 Apr. 21, 2022

(30) Foreign Application Priority Data

Jul. 19, 2019 (CN) ..... 201910655268.1

(51) Int. Cl.
*F04D 9/02* (2006.01)
*F04D 1/00* (2006.01)

(52) U.S. Cl.
CPC ..... *F04D 9/02* (2013.01); *F04D 1/00* (2013.01)

(58) Field of Classification Search
CPC .... F04D 9/00–9/049; F04D 13/12; F04D 1/00
(Continued)

(56) References Cited

U.S. PATENT DOCUMENTS 4,035,104 A * 7/1977 Buse ..... F04D 9/043 417/202
4,645,428 A * 2/1987 Arregui ..... F04B 27/053 417/273

FOREIGN PATENT DOCUMENTS

CN 201162682 Y 12/2008
CN 108894992 A 11/2018
CN 110397599 A 11/2019

* cited by examiner

*Primary Examiner* — Philip E Stimpert
(74) *Attorney, Agent, or Firm* — Bayramoglu Law Offices LLC

(57) ABSTRACT

A self-priming starting device for a centrifugal pump is mounted on a water inlet pipe of the centrifugal pump and includes an outer housing, an inner housing, a primary spacer, a secondary spacer, an opening and closing disc and a tertiary spacer which are sequentially provided in the outer housing from top to bottom, and an elastic steel plate provided in the water inlet pipe. A drum is provided in the inner housing, and air inlet pipes and air discharging pipes are provided on the inner housing. The drum is provided with drum chambers and a three-blade support is provided in the drum. The opening and closing disc is provided with a vertical rod. A gas-liquid cutter is provided between the primary spacer and the secondary spacer. The primary spacer, the secondary spacer, the opening and closing disc and the tertiary spacer are provided with through-holes.

9 Claims, 1 Drawing Sheet

(58) Field of Classification Search
USPC ..... 417/199–203
See application file for complete search history.

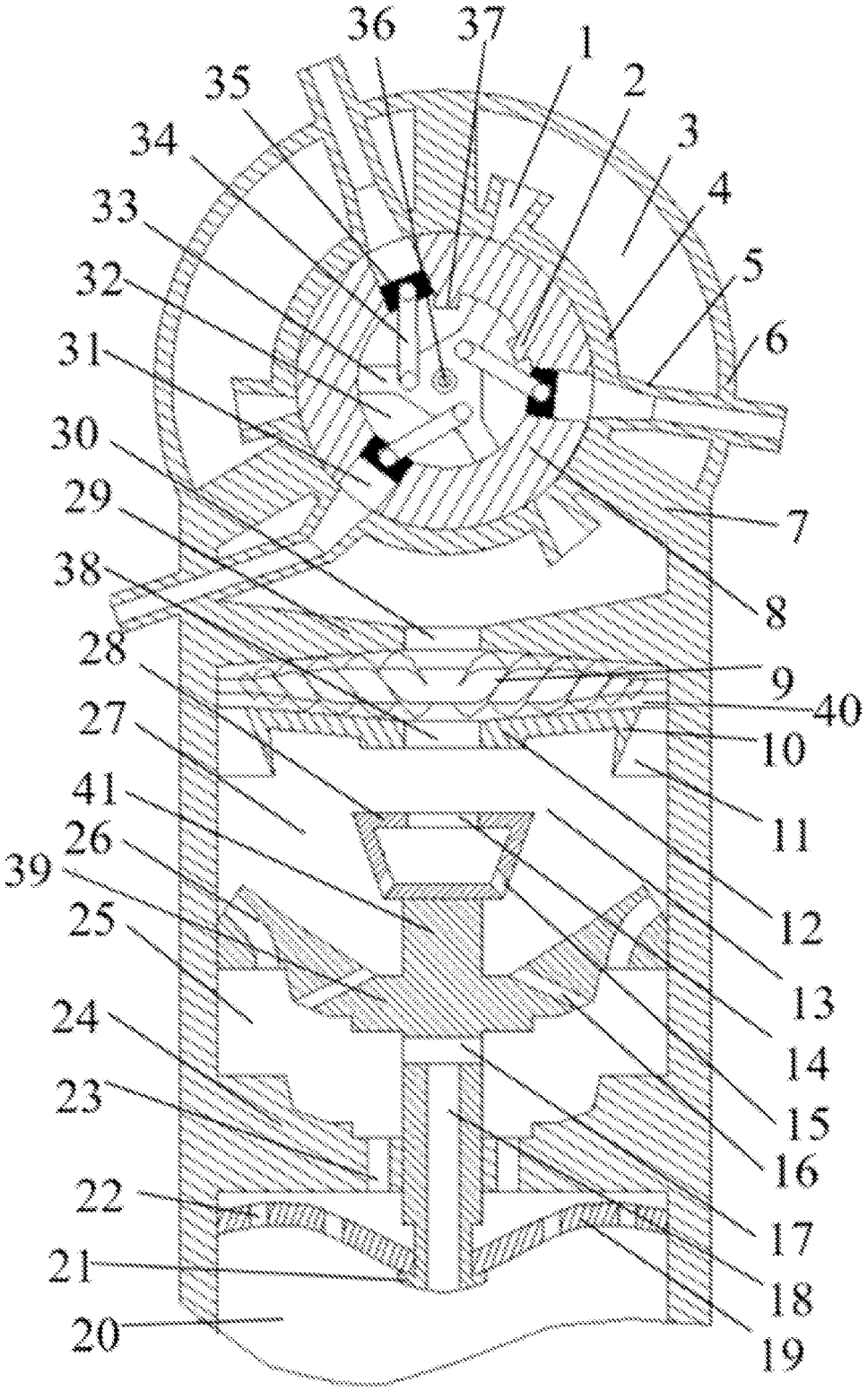
36
37
1
35
2
34
3
33
4
32
5
31
6
30
29
7
38
8
28
9
40
27
10
41
11
26
39
12
25
13
24
14
23
15
16
22
17
21
18
20
19

SELF-PRIMING STARTING DEVICE FOR CENTRIFUGAL PUMP

CROSS REFERENCE TO THE RELATED APPLICATIONS

This application is the national phase entry of International Application No. PCT/CN2019/126818, filed on Dec. 20, 2019, which is based upon and claims priority to Chinese Patent Application No. 201910655268.1, filed on Jul. 19, 2019, the entire contents of which are incorporated herein by reference.

TECHNICAL FIELD

The present invention relates to a self-priming starting device, and in particular to a self-priming starting device for a centrifugal pump.

BACKGROUND

As important fluid machinery, centrifugal pumps are widely used in various conveying systems in agriculture, industry, biology and medicine. However, the centrifugal pumps currently used in the market require irrigation to the inside of the pump cavity before each start, which is a complex operation with a large workload and a long start-up cycle, making it difficult to meet the requirements for rapid water transfer.

Although the self-priming centrifugal pump requires irrigation except for the first start, the subsequent start-up process can be carried out directly, but the complex structure of the self-priming centrifugal pump, the internal flow field has a large turbulent energy loss, and gas-liquid mixing and gas-liquid separation occur inside the pump cavity, which will damage the internal hydraulic components and make replacement and maintenance very difficult. At the same time, in the self-priming start-up process, the gas-liquid separation process occurs inside the pump chamber, which is very easy to form a gas nucleus inside the pump chamber, resulting in incomplete gas-liquid separation and reducing the self-priming efficiency.

SUMMARY

In view of the deficiencies in the prior art, the present invention provides a self-priming starting device for a centrifugal pump, which can effectively discharge the air in the pump chamber during the self-priming process, and at the same time can adjust the self-priming speed according to the different pressures in the pump chamber, so as to achieve efficient gas-liquid separation and air discharge in the self-priming process.

The present invention achieves the above technical objective by means of the following technical means.

A self-priming starting device for a centrifugal pump is mounted on a water inlet pipe of the centrifugal pump and includes an outer housing, an inner housing, a drum, a three-blade support, a primary spacer, a secondary spacer, a tertiary spacer, an opening and closing disc, and an elastic steel plate.

The outer housing has a bottom being in communication with the water inlet pipe, and the primary spacer, the secondary spacer and the tertiary spacer are provided sequentially in the outer housing from top to bottom, and are configured to separate an inner cavity of the outer housing.

The primary spacer is provided with a primary spacer through-hole, the inner housing is provided above the primary spacer through a support, an outer wall of the inner housing forms an outer self-priming chamber with an inner wall of the outer housing and a top wall of the primary spacer, the inner housing is provided with a plurality of air inlet pipes and air discharging pipes, the air inlet pipes are in communication with the outer self-priming chamber and the air discharging pipes are in communication with the atmosphere.

The drum is provided in the inner housing and fits closely to an inner wall of the inner housing, the drum is provided with a plurality of drum chambers, and the air inlet pipes, the air discharging pipes and the drum chambers have an equal number and are evenly distributed in a circumferential direction. The drum forms an inner self-priming chamber inside. The three-blade support has a rotating body and three support rods evenly distributed on the rotating body in a circumferential direction, the three-blade support is rotatably arranged within the inner self-priming chamber, the drum is provided with two limit blocks on an inner wall of the drum, a top of a support rod of the three support rods is located between the two limit blocks, each of the drum chambers is provided with a piston, and the piston is connected to the rotating body via a connecting rod.

The secondary spacer and the primary spacer form a gas-liquid separation chamber therebetween, and a gas-liquid cutter is provided in the gas-liquid separation chamber. The gas-liquid cutter has spiral blades attached to a surface of the gas-liquid cutter. The secondary spacer is provided with a secondary spacer through-hole. The secondary spacer has a plurality of gas-liquid inlets near the inner wall of the outer housing, and a gas-liquid separation plate is provided beside the gas-liquid inlets.

The secondary spacer, the tertiary spacer and the outer housing form a gas-liquid chamber therebetween, the opening and closing disc is installed in the gas-liquid chamber and is configured to slide up and down along a wall surface of the outer housing and divide the gas-liquid chamber into an upper gas-liquid chamber and a lower gas-liquid chamber. The opening and closing disc is provided with a plurality of secondary drainage holes. The opening and closing disc is provided with a vertical rod in a middle, and the vertical rod is provided with a transverse through-hole and a longitudinal through-hole. A first end of the longitudinal through-hole is in communication with the transverse through-hole, and a second end of the longitudinal through-hole is in communication with the water inlet pipe, and the opening and closing disc has a bottom wall being configured to fit completely against an upper wall of the tertiary spacer.

The tertiary spacer is provided with a plurality of tertiary spacer through-holes, the tertiary spacer through-holes communicate the lower gas-liquid chamber with the water inlet pipe. The elastic steel plate in a curved shape is fixed on an inner wall surface of the water inlet pipe, the elastic steel plate is provided with a plurality of elastic steel plate through-holes. A bottom end of the vertical rod extends through the tertiary spacer and the elastic steel plate, and the bottom end of the vertical rod is provided with a limit boss.

Preferably, the opening and closing disc has a concave cross-section, the opening and closing disc has a stepped bottom, and a top of the tertiary spacer is provided with a groove being configured to engage with the bottom of the opening and closing disc, so that the bottom wall of the opening and closing disc is configured to fit closely to the upper wall of the tertiary spacer.

Preferably, the numbers of the air inlet pipes, the air discharging pipes and the drum chambers are three.

Preferably, in a direction from the outer self-priming chamber to the drum, the air inlet pipes each have a tapering inner diameter with a tapering angle of 20°, and in a direction from the inner self-priming housing to the outer housing, the air discharging pipes each include a constricted section and a cylindrical section, and the constricted section has a constriction angle of 40°.

Preferably, the two limit blocks on the inner wall of the drum are an upper positioning boss and a lower positioning boss, respectively, a connecting line between a center of the upper positioning boss and a center of the three-blade support is L1, and a connecting line between a center of the lower positioning boss and the center of the three-blade support is L2, and an angle between the L1 and the L2 is 100°.

Preferably, a resilient deformation valve is provided on a top of the vertical rod, the resilient deformation valve has a trapezoidal cross-section, the resilient deformation valve is provided with a resilient deformation valve through-hole at a top, the resilient deformation valve has a primary drainage hole at a bottom of a side wall, and a ratio of a diameter of the resilient deformation valve through-hole to a diameter of the primary drainage hole is 4:1.

Preferably, the gas-liquid cutter has a circular cross-section, and a diameter of the gas-liquid cutter gradually decreases from a middle to two ends, the spiral blades on the two ends of the gas-liquid cutter are rotated in opposite directions, and a distance between adjacent two of the spiral blades gradually increases in a direction from the two ends to the middle of the gas-liquid cutter.

Preferably, a ratio of a diameter of the primary spacer through-hole, a diameter of the secondary spacer through-hole and the diameter of the resilient deformation valve through-hole is 1:1:1.

Preferably, a plurality of impact curved holes are provided on the opening and closing disc near the inner wall of the outer housing, and the impact curved holes are symmetrical two by two with respect to the vertical rod, and the secondary drainage holes are symmetrical two by two with respect to the vertical rod. The impact curved holes, the secondary drainage holes and the primary drainage holes have an equal number. The impact curved holes each are an equidiameter curved hole, the impact curved holes each have an arc of 25°, the impact curved holes each have a diameter that is twice a diameter of each of the secondary drainage holes, and an angle between an axis of a top outlet of each of the impact curved holes and a wall surface of the gas-liquid chamber is 15°.

Preferably, the piston, the gas-liquid cutter, the resilient deformation valve are made of a rubber material, and the elastic steel plate is made of 45# steel, and the remaining components are formed by processing a graphene material.

BENEFICIAL EFFECTS OF THE PRESENT INVENTION

1) In the present invention, the triangular support reciprocates one cycle process, simultaneously three times exhaust and three times suction, self-absorption efficiency is high, extraction and exhaust speed is fast. At the same time, the use of reciprocating motion structure form can effectively improve the shortcomings of the traditional self-priming device in the form of circular motion structure form occupying a large space, to ensure that the device in a limited space to quickly complete three times the extraction and three times the exhaust process, and the present invention uses three layers of chambers, effectively separating the suction and exhaust process, improving the self-priming efficiency.

2) The centrifugal pump self-priming starting device used in the present invention is installed on the inlet pipe, making the entire self-priming process of gas-liquid mixing and gas-liquid separation occur in the front of the pump chamber, reducing the vibration and noise generated in the pump body, and reducing the damage to the pump body itself by two-phase flow. At the same time, the whole device and the pump body are in two parts, which makes it easy to disassemble for maintenance and replacement in the event of a fault, ensuring efficient and smooth operation of the system.

3) The opening and closing discs used in the present invention divide the gas-liquid chamber into two parts: the upper gas-liquid chamber and the lower gas-liquid chamber. The pressure difference between the upper gas-liquid chamber and the lower gas-liquid chamber is used to raise or lower the lifting height of the opening and closing discs, so as to further adjust the opening degree between the inlet pipe and the lower gas-liquid chamber. At the end of self-priming, the lower surface of the opening/closing disc and the upper surface of the tertiary spacer are closely aligned to completely close the connection between the inlet pipe and the lower gas-liquid chamber, ensuring that no leakage occurs after the device has finished self-priming.

4) The present invention adopts the structure form of gas-liquid cutter and gas-liquid separation plate, which can effectively separate the gas-liquid mixture at the end of self-priming. The gas-liquid mixture goes through a total of five gas-liquid separations in the process of gas-liquid separation chamber, which can thoroughly separate the water in the gas-liquid mixture and effectively improve the exhaust efficiency of the self-priming device, and can return the water to the inlet pipe to reduce the discharge of water in the self-priming process.

5) In the present invention, the opening and closing disc is fitted with a structure in the form of impact curved holes, the air in the lower gas-liquid chamber enters the upper gas-liquid chamber through the impact curved holes, which on the one hand can effectively prevent the opening and closing disc from being offset and overturned, making the opening and closing disc stuck in the gas-liquid chamber, on the other hand, when the air or gas-liquid mixture impacts on the inner wall surface of the gas-liquid chamber, a layer of adhesion will be formed on the inner wall surface, fully playing the role of lubrication. This reduces the resistance of the opening and closing disc to rise and facilitates the lifting of the opening and closing disc.

6) On the one hand, it prevents the opening and closing disc from being lifted too high and the connecting rod of the opening and closing disc from colliding with the secondary spacer, which plays a cushioning role; on the other hand, at the end of self-priming, it collects the water falling back from the through-hole of the secondary spacer and increases the overall mass of the opening and closing disc, so that the opening and closing disc can fall back to the tertiary spacer, and at the same time, there is a At the same time, a secondary drainage hole is opened underneath the resilient deformation valve to drain the water from the resilient deformation valve without residue and to increase the resistance to secondary start-up.

BRIEF DESCRIPTION OF THE DRAWINGS

FIGURE shows a schematic diagram of the structure of a preferred embodiment of a self-priming starting device for a centrifugal pump as described in the present invention.

REFERENCE NUMERALS

1—inlet pipe; 2—lower positioning boss; 3—outer self-priming chamber; 4—inner housing; 5—air discharging pipe; 6—outer housing; 7—support; 8—drum; 9—gas-liquid cutter; 10—gas-liquid separation plate; 11—gas-liquid inlet; 12—secondary spacer; 13—gas-liquid chamber; 14—resilient deformation valve through-hole; 15—primary drainage hole; 16—secondary drainage hole; 17—transverse through-hole; 18—longitudinal through-hole; 19—elastic steel plate; 20—inlet pipe; 21—limit boss; 22—elastic steel plate through-hole; 23—tertiary spacer through-hole; 24—tertiary spacer; 25—lower gas-liquid chamber; 26—impact bend hole; 27—upper gas-liquid chamber; 28—resilient deformation valve; 29—primary spacer; 30—primary spacer through-hole; 31—inner drum chamber; 32—inner self-priming chamber; 33—three-blade support 34—connecting rod; 35—piston; 36—central shaft; 37—upper positioning boss; 38—secondary septum through-hole; 39—opening and closing disc; 40—gas-liquid separation chamber; 41—vertical rod.

DETAILED DESCRIPTION OF THE EMBODIMENTS

Embodiments of the present invention are described in detail below, examples of the embodiments being shown in the accompanying drawings, wherein the same or similar designations from beginning to end indicate the same or similar elements or elements having the same or similar functions. The embodiments described below by reference to the accompanying drawings are exemplary and are intended to be used to explain the present invention and are not to be understood as limiting the present invention.

In the description of the present invention, it is to be understood that the terms "centre", "longitudinal", "transverse", "length", "width", "thickness", "upper", "lower", "axial", "radial", "vertical" and "vertical". "axial", "radial", "vertical", "horizontal", "inner", "outer", "outside", etc. indicate orientations or positional relationships based on those shown in the accompanying drawings and are intended only to facilitate and simplify the description of the present invention, not to indicate or imply that the device or element referred to must have a particular orientation, be constructed and operate in a particular orientation, and therefore are not to be construed as limitation of the present invention. Furthermore, the terms "first" and "second" are used for descriptive purposes only and are not to be understood as indicating or implying relative importance or as implicitly specifying the number of technical features indicated. Thus, a feature qualified with "first" and "second" may explicitly or implicitly include one or more of these features. In the description of the present invention, "plurality" means two or more, unless otherwise expressly and specifically limited.

For the purposes of the present invention, unless otherwise expressly specified and limited, the terms "mounted", "connected", "connected", "fixed " and the like shall be understood in a broad sense, for example, as a fixed connection, as a detachable connection, or as a one-piece connection; as a mechanical connection or as an electrical connection; as a direct connection or as an indirect connection through an intermediate medium, or as a connection within two components. For a person of ordinary skill in the art, the specific meaning of the above terms in the context of the present invention can be understood on a case-by-case basis.

A self-priming starting device for a centrifugal pump according to an embodiment of the present invention is first described in detail below in connection with the accompanying drawings.

Referring to FIG. 1, a self-priming starting device for a centrifugal pump according to an embodiment of the present invention, comprising an outer housing 6, an inner housing 4, a drum 8, a three-blade support 33, a primary spacer 29, a secondary spacer 12, a tertiary spacer 24, an opening and closing disc 39 and an elastic steel plate 19.

Specifically, the bottom of the outer housing 6 is connected to the inlet pipe 20 and the primary spacer 29, secondary spacer 12 and tertiary spacer 24 are provided in order from top to bottom within the outer housing 6 and separate the inner housing of the outer housing 6.

The outer wall of the inner housing 4 is connected to the inner wall of the outer housing 6 and to the top wall of the first level housing 29 to form the outer self-priming chamber 3, with three air inlet pipes 1 and three air discharging pipes 5 on the inner housing 4. 5 through the outer housing 6 to the outside atmosphere.

The drum 8 is set inside the inner housing 4 and fits closely to the inner wall of the inner housing 4, three inner drum chambers 31 are opened on the drum 8, the air inlet pipe 1, the air discharging pipe 5 and the inner drum chambers 31 are evenly distributed along the circumference, the inner self-priming chamber 32 is formed inside the drum 8, a central shaft 36 is installed in the inner self-priming chamber 32, a three-blade support 33 is installed on the central shaft 36, the three-blade support 33 can reciprocate around the central shaft 36 The three-blade support 33 is mounted on the central shaft 36 and the three-blade support 33 can rotate back and forth around the central shaft 36. The three-blade support 33 has a rotating body and three support rods evenly distributed around the circumference of the rotating body. The inner wall of the drum 8 is provided with two limit blocks, the two limit blocks are the upper positioning boss 37 and the lower positioning boss 2, the line between the upper positioning boss 37 and the centre of the three-blade support 33 is L1, the line between the lower positioning boss 2 and the centre of the three-blade support 33 is L2, the angle between L1 and L2 is 100. The top of one of the support bars is positioned between the upper positioning boss 37 and the lower positioning boss 2. The trefoil support 33 can rotate the drum 8 by means of the upper positioning boss 37 or the lower positioning boss 2. Each drum cavity 31 is provided with a piston 35, which is free to slide along the central axis of the drum cavity 31. The piston 35 is connected to the rotating body by means of a connecting rod 34, the thickness of the piston 35 being one third of the depth of the drum cavity 31.

The secondary spacer 12 is provided with a secondary spacer through-hole 38 in the centre, a number of gas-liquid inlets 11 are provided on the secondary spacer 12 near the inner wall of the outer housing 6, and a gas-liquid separation plate 10 is provided next to the gas-liquid inlet 11, which has a triangular cross-section.

The gas-liquid separation chamber 40 is formed between the secondary spacer 12 and the primary spacer 29, the gas-liquid cutter 9 is set in the liquid separation chamber 40, the surface of the gas-liquid cutter 9 is attached with spiral-shaped blades, the cross-section of the gas-liquid cutter 9 is circular, the diameter of the gas-liquid cutter 9 gradually decreases from the middle to the two ends, so that the gas-liquid cutter 9 has a diamond-shaped cylindrical shape, the spiral-shaped blades on the two ends of the gas-liquid cutter 9 rotate in opposite directions, and The distance between the two blades gradually increases in the direction from the two ends of the gas-liquid cutter 9 to the middle, with the smallest distance between the two blades at the gas-liquid inlet 11.

The opening and closing disc 39 is installed in the gas-liquid cavity 13 and can slide up and down along the wall of the outer housing 6, the cross section of the opening and closing disc 39 is concave, the bottom of the opening and closing disc 39 is step-shaped, the top of the tertiary spacer 24 is provided with a groove that fits the bottom of the opening and closing disc 39, so that the bottom wall of the opening and closing disc 39 can closely fit with the top wall of the tertiary spacer 24. The top of the tertiary spacer 24 is provided with a groove that fits the bottom of the opening and closing disc 39, so that the bottom wall of the opening and closing disc 39 fits closely to the top wall of the tertiary spacer 24. The opening and closing disc 39 divides the gas-liquid chamber 13 into an upper gas-liquid chamber 27 and a lower gas-liquid chamber 25, a number of secondary drainage holes 16 are provided in the opening and closing disc 39, a number of impact bends 26 are provided in the opening and closing disc 39 near the inner wall of the outer housing 6, the impact bends 26 are symmetrical two by two about the vertical rod 41. The secondary drainage holes 16 are symmetrical about the vertical rod 41, the number of impact bends 26, secondary drainage holes 16 and primary drainage holes 15 are the same, the impact bends 26 are equal diameter bends, the arc of impact bends 26 is 25°. The diameter of the impact curved hole 26 is twice the diameter of the secondary drainage hole 16, the top outlet of the impact curved hole 26 faces the wall of the gas-liquid chamber 13, and the axis of the top outlet of the impact curved hole 26 is at an angle of 15° to the wall of the gas-liquid chamber 13.

The opening and closing disc 39 is provided with a vertical rod 41 in the middle, in order to avoid the opening and closing disc 39 being raised too high and colliding with the secondary spacer 12, the top of the vertical rod 41 is installed with a resilient deformation valve 28, the resilient deformation valve 28 has a trapezoidal cross section, the resilient deformation valve 28 is made of rubber material, which can effectively cushion the impact. The top of the resilient deformation valve 28 is provided with a resilient deformation valve through-hole 14, and the bottom of the side wall is opened with a primary drainage hole 15. The ratio of the diameter of the resilient deformation valve through-hole 14 to the diameter of the primary drainage hole 15 is 4:1, and the ratio of the diameter of the primary spacer through-hole 30, the diameter of the secondary spacer through-hole 38 to the diameter of the resilient deformation valve through-hole 14: 1:1. The vertical rod 41 is provided with a transverse through-hole 17 and a longitudinal through-hole 18, with the transverse through-hole 17 connected to the lower gas-liquid chamber 25 and the longitudinal through-hole 18 connected to the transverse through-hole 17 at one end and to the inlet pipe 20 at the other. The longitudinal through-hole 18 is connected at one end to the transverse through-hole 17 and at the other end to the inlet pipe 20.

The tertiary spacer 24 is provided with a number of tertiary spacer through-holes 23, the tertiary spacer through-holes 23 connects the lower gas-liquid chamber 25 with the inlet pipe 20, the wall of the inlet pipe 20 is fixed with a curved elastic steel plate 19, the elastic steel plate 19 is provided with a number of elastic steel plate through-holes 22, the bottom end of the vertical rod 41 passes through the tertiary spacer 24 and the elastic steel plate 19, and the bottom end of the vertical rod 41 is provided with a limit boss 21. The diameter of the limiting tab 21 is larger than the diameter of the hole in the middle of the elastic steel plate 19 and cannot pass through the hole in the middle of the elastic steel plate 19. The cooperation between the limiting tab 21 and the elastic steel plate 19 can effectively prevent the opening and closing disc 39 from being lifted too high and colliding with the lower surface of the secondary spacer 12.

The piston 35, the gas-liquid cutter 9 and the resilient deformation valve 28 are made of rubber material, the elastic steel plate is machined from 45 gauge steel and the rest of the components are machined and shaped from graphene material.

The working process of a self-priming starting device for a centrifugal pump according to an embodiment of the present invention.

At the beginning of the self-priming process, the three-blade support 33 rotates clockwise and when the rectangular support of the three-blade support 33 touches the lower positioning boss 2 on the inner wall of the drum 8, the whole drum 8 rotates clockwise with the three-blade support 33. As the three-blade support 33 rotates, it drives the connecting rod 34 to oscillate and the piston 35 is driven by the connecting rod 34 to continuously reach into the drum inner cavity 31. When the piston 35 reaches the top of the drum inner cavity 31, the drum inner cavity 31 forms a buttress with the air inlet pipe 1.

Subsequently, the three-blade support 33 is rotated counterclockwise and when the rectangular support of the three-blade support 33 touches the upper positioning boss 37 on the inner wall surface of the drum 8, the entire drum 8 rotates counterclockwise with the three-blade support 33 and the piston 35, driven by the connecting rod 34, moves closer and closer to the central shaft 36, creating a negative pressure in the inner cavity 31 of the drum, which is then connected to the air inlet pipe 1. Under the action of the pressure difference, the air in the outer self-priming chamber 3 is continuously extracted into the inner chamber 31 of the drum via the air inlet pipe 1. As the drum 8 rotates counterclockwise, the inner chamber 31 of the drum is gradually disconnected from the air inlet pipe 1. When the drum cavity 31 is completely disconnected from the air inlet pipe 1, the air is stored in the closed space formed between the drum cavity 31 and the inner wall surface of the inner housing 4. The air is continuously compressed by the piston 35, and as the drum 8 rotates until the drum cavity 31 is connected to the air discharging pipe 5, the compressed air inside the drum cavity 31 is quickly discharged into the atmosphere through the air discharging pipe 5. When the three-blade support 33 is turned back and forth once, three pumping and three venting processes can be completed simultaneously. When the air in the outer self-priming chamber 3 is pumped into the inner chamber 31 of the drum, it can be effectively boosted by the tapering inlet pipe 1 to speed up the pumping speed, and the air discharging pipe 5 includes a contraction section and a smooth section. Since the gas discharged in the air discharging pipe 5 is the compressed gas from the inner cavity 31 of the drum, too fast a discharge rate in the air discharging pipe 5 will cause vibration of the device, therefore, to ensure the smooth and reliable operation of the device, the constriction angle of the air discharging pipe 5 is twice the constriction angle of the inlet pipe 1. Appropriate reduction of the discharge rate of the compressed gas in the air discharging pipe 5 reduces the vibration and noise generated during the exhaust process.

As the three-blade support 33 continues to rotate back and forth, the air in the outer self-priming chamber 3 is continuously extracted and discharged into the atmosphere, so that the pressure in the outer self-priming chamber 3 is continuously reduced. Since the outer self-priming chamber 3 is connected to the gas-liquid separation chamber 40 by means of a primary spacer through-hole 30 in the centre of the primary spacer 29, the air in the gas-liquid separation chamber 40 not only enters the outer self-priming chamber 3 under the effect of the pressure difference, but also enters the inner chamber 31 of the drum with the air in the outer self-priming chamber 3 and is finally discharged into the atmosphere. At the same time, as the gas-liquid separation chamber 40 is connected to the gas-liquid chamber 13 through the secondary spacer 38 in the secondary spacer 12 and the gas-liquid inlet 11, the air from the gas-liquid chamber 13 enters the external self-priming chamber 3 with the gas-liquid separation chamber 40 and is finally discharged to the atmosphere.

Before the start-up device of the present invention is activated, the lower surface of the opening and closing disc 39 is closely fitted to the upper surface of the tertiary spacer 24 and a closure is formed between the gas-liquid chamber 13 and the inlet pipe 20. As the air in the outer self-priming chamber 3 is continuously pumped out, the air pressure on the upper surface of the opening and closing disc 39 decreases and the opening and closing disc 39 is lifted under the effect of the pressure difference. At this point, the lower surface of the opening and closing disc 39 is disconnected from the upper surface of the tertiary spacer 24 and the tertiary spacer through-hole 23 forms a connection between the lower gas-liquid chamber 25 and the inlet pipe 20.

When the lower surface of the opening and closing disc 39 is detached from the upper surface of the tertiary spacer 24, the transverse through-hole 17 forms a connection with the lower gas-liquid chamber 25 and through the longitudinal through-hole 18 with the inlet pipe 20. Thus, part of the air in the inlet pipe 20 enters the lower gas-liquid chamber 25 via the tertiary spacer through-hole 23, and the other part enters the lower gas-liquid chamber 25 via the longitudinal through-hole 18 and the transverse through-hole 17.

A portion of the air entering the lower air-liquid chamber 25 passes through the secondary drainage hole 16 into the upper air-liquid chamber 27 and is eventually discharged into the atmosphere with the air in the outer self-priming chamber 3. The other part is sprayed on the inner wall of the gas-liquid chamber 13 through the impact curved hole 26 and enters the upper gas-liquid chamber 27, where it is sprayed on the inner wall of the gas-liquid chamber 13 through the impact curved hole 26, which ensures that the opening and closing disc 39 remains balanced. At the same time the air layer sprayed on the inner wall of the gas-liquid chamber 13 adheres to the surface of the gas-liquid chamber 13, acting as air lubrication and facilitating the lifting of the opening and closing disc 39.

With the reciprocal rotation of the three-blade support 33, air is continuously expelled from the unit, the air in the inlet pipe 20 is gradually reduced and the water level in the inlet pipe 20 is gradually raised. At this point, the medium entering the lower gas-liquid chamber 25 through the tertiary spacer aperture 23 and the lower gas-liquid chamber 25 through the longitudinal aperture 18 and the transverse aperture 17 is no longer a single air, but a gas-liquid mixture. The gas-liquid mixture in the lower gas-liquid chamber 25 enters the upper gas-liquid chamber 27 through the secondary drainage hole 16 and the impact bend hole 26, part of the gas-liquid mixture enters the gas-liquid separation chamber 40 through the gas-liquid inlet 11, when the gas-liquid mixture impacts the gas-liquid separation plate 10 next to the gas-liquid inlet 11 to produce the first gas-liquid separation. After gas-liquid separation part of the liquid falls back into the upper gas-liquid chamber 27, the remaining gas-liquid mixture which is not completely and thoroughly separated enters the gas-liquid separation chamber 40, where a spiral flow path is formed due to the installation of the gas-liquid cutter 9 with spiral blades in the gas-liquid separation chamber 40. On the one hand the gas-liquid mixture undergoes centrifugal motion in the spiral flow channel inside the gas-liquid separation chamber 40, while the density of water is greater than that of air. On the other hand, the gas-liquid mixture flows through the spiral-shaped blades in the gas-liquid cutter 9 to create separation. As the spiral-shaped blades on both sides of the gas-liquid cutter 9 rotate in opposite directions, and the gas-liquid mixture passes through the opposite spiral-shaped flow channels in the gas-liquid separation chamber 40, it collides above the secondary spacer through-hole 38, causing the liquid in the gas-liquid mixture to gather together and fall back down by gravity through the secondary spacer through-hole 38 into the upper gas-liquid chamber 27. The liquid in the gas-liquid mixture gathers together and falls back into the upper gas-liquid chamber 27 by gravity. At the same time, another part of the gas-liquid mixture flows into the gas-liquid separation chamber 40 through the secondary spacer aperture 38, where it further collides with the falling liquid, separating the gas-liquid mixture flowing through the secondary spacer aperture 38, and finally the separated gas enters the outer self-priming chamber 3 through the primary spacer aperture 30, and is finally discharged into the atmosphere with the reciprocating movement of the three-blade support 33.

When the self-priming process proceeds to the end, at this time the three-blade support 33 stops reciprocating, the inlet pipe 20 is filled with water, while the opening and closing disc 39 is raised to its maximum height, the elastic deformation valve 28 is compressively deformed, and the elastic deformation valve through-hole 14 forms a buttress with the secondary spacer through-hole 38. And the elastic steel plate 19 inside the inlet pipe 20 is deformed elastically under the tension of the limiting tab 21, and the resilient deformation valve 28 on the vertical rod 41 comes into contact with the secondary spacer 12. The large amount of liquid separated in the gas-liquid separation chamber 40 enters the resilient deformation valve 28 after passing through the secondary spacer through-hole 38 and the resilient deformation valve through-hole 14. As the bottom of the resilient deformation valve 28 is opened with a primary drainage hole 15, the liquid entering the resilient deformation valve 28 is discharged into the upper gas-liquid chamber 27 with the primary drainage hole 15, but the overall flow of liquid entering the resilient deformation valve 28 through the resilient deformation valve through-hole 14 is significantly larger than the discharge flow of the primary drainage hole 15, thus making the liquid inside the resilient deformation valve 28 continuously increase. The liquid discharged from the primary drainage hole 15 accumulates on the upper surface of the opening and closing disc 39 and continuously enters the lower gas-liquid cavity 25 through the secondary drainage hole 16, where the liquid in the resilient deformation valve 28 and the gravity of the liquid on the upper surface of the opening and closing disc 39, the recovery force after deformation of the resilient deformation valve 28 and the elasticity of the elastic steel plate 19, the opening and closing disc 39 gradually starts to fall back and the liquid entering the lower gas-liquid cavity 25 A part of it flows back into the inlet pipe 20 through the tertiary spacer through-hole 23. The other part is discharged into the inlet pipe 20 through the transverse through-hole 17 and longitudinal through-hole 18 in turn. When the opening and closing disc 39 falls back to the upper surface of the tertiary spacer 24, the elastic deformation valve 28 and the opening and closing disc 39 have no liquid on the upper surface, and the opening and closing disc 39 closes the connection between the lower gas-liquid cavity 25 and the inlet pipe 20 under its own gravity, effectively overcoming the problem of high resistance when the device is started again caused by the gravity of the residual liquid. This effectively overcomes the problem of high resistance when the device is started again due to the gravity of the residual liquid.

In the description of this specification, reference to the terms "an embodiment", "some embodiments", "example", "specific example", or "some examples" means that the specific features, structures, materials or characteristics described in connection with the embodiment or example are included in at least one embodiment or example of the present invention", or "some examples" means that the specific features, structures, materials or characteristics described in connection with the embodiment or example are included in at least one embodiment or example of the present invention. In this specification, schematic expressions for the above terms do not necessarily refer to the same embodiments or examples. Furthermore, the specific features, structures, materials or characteristics described may be combined in a suitable manner in any one or more of the embodiments or examples.

Although embodiments of the present invention have been shown and described above, it is understood that the above embodiments are exemplary and are not to be construed as limiting the present invention and that variations, modifications, replacements and variants of the above embodiments may be made by those of ordinary skill in the art within the scope of the present invention without departing from the principles and purposes of the present invention.

What is claimed is:

1. A self-priming starting device for a centrifugal pump, wherein the self-priming starting device is mounted on a water inlet pipe of the centrifugal pump and comprises an outer housing, an inner housing, a drum, a three-blade support, a primary spacer, a secondary spacer, a tertiary spacer, an opening and closing disc, and an elastic steel plate;

the outer housing has a bottom being in communication with the water inlet pipe, and the primary spacer, the secondary spacer and the tertiary spacer are provided sequentially in the outer housing—from top to bottom;

the primary spacer is provided with a primary spacer through-hole, the inner housing is provided above the primary spacer through a support, an outer wall of the inner housing forms an outer self-priming chamber with an inner wall of the outer housing and a top wall of the primary spacer, the inner housing is provided with a plurality of air inlet pipes and a plurality of air discharging pipes, the air inlet pipes are in communication with the outer self-priming chamber, and the air discharging pipes are in communication with an atmosphere;

the drum is provided in the inner housing and fits within an inner wall of the inner housing, the drum is provided with a. plurality of drum chambers, and the air inlet pipes, the air discharging pipes and the drum chambers have an equal number and are evenly distributed in a circumferential direction, the drum forms an inner self-priming chamber inside, the three-blade support has a rotating body and three support rods evenly distributed on the rotating body in a circumferential direction, the three-blade support is rotatably arranged in the inner self-priming chamber, the drum is provided with two limit blocks on an inner wall of the drum, a. top of a support rod of the three support rods is located between the two limit blocks, each of the drum chambers is provided with a piston, and the piston is connected to the rotating body via a connecting rod;

the secondary spacer and the primary spacer form a gas-liquid separation chamber-therebetween, and a gas-liquid cutter is provided in the gas-liquid separation chamber, the gas-liquid cutter has spiral blades attached to a surface of the gas-liquid cutter, the secondary spacer is provided with a secondary spacer through-hole, the secondary spacer has a plurality of gas-liquid inlets near the inner wall of the outer housing, and a gas-liquid separation plate is provided beside the gas-liquid inlets;

the secondary spacer, the tertiary spacer and the outer housing form a gas-liquid chamber therebetween, the opening and closing disc is installed in the gas-liquid chamber and is configured to slide up and down along a wall surface of the outer housing and divide the gas-liquid chamber into an upper gas-liquid chamber and a lower gas-liquid chamber, the opening and closing disc is provided with a plurality of secondary drainage holes, the opening and closing disc is provided with a vertical rod in a middle, and the vertical rod is provided with a transverse through-hole and a longitudinal through-hole, a first end of the longitudinal through-hole is in communication with the transverse through-hole, and a second end of the longitudinal through-hole is in communication with the water inlet pipe, and the opening and closing disc has a bottom wall being configured to fit completely against an upper wall of the tertiary spacer; and the tertiary spacer is provided with a plurality of tertiary spacer through-holes, the tertiary spacer through-holes communicate the lower gas-liquid chamber with the water inlet pipe, the elastic steel plate in a curved shape is fixed on an inner wall surface of the water inlet pipe, the elastic steel plate is provided with a plurality of elastic steel plate through-holes, a bottom end of the vertical rod extends through the tertiary spacer and the elastic steel plate, and the bottom end of the vertical rod is provided with a limit boss.

2. The self-priming starting device for the centrifugal pump according to claim 1, wherein the opening and closing disc has a concave cross-section, the opening and closing disc has a stepped bottom, and a top of the tertiary spacer is provided with a groove being configured to engage with the stepped bottom of the opening and closing disc, so that the bottom wall of the opening and closing disc is configured to fit closely to the upper wall of the tertiary spacer.

3. The self-priming starting device for the centrifugal pump according to claim 1, wherein a number of the air inlet pipes, a number of the air discharging pipes and a number of the drum chambers are all three.

4. The self-priming starting device for the centrifugal pump according to claim 1, wherein in a direction from the outer self-priming chamber to the drum, the air inlet pipes each have a tapering inner diameter with a tapering angle of 20°, and in a direction from the inner housing to the outer housing, the air discharging pipes each comprise a constricted section and a cylindrical section, and the constricted section has a constriction angle of 40°.

5. The self-priming starting device for the centrifugal pump according to claim 1, wherein a resilient deformation valve is provided on a top of the vertical rod, the resilient deformation valve has a trapezoidal cross-section, the resilient deformation valve is provided with a resilient deformation valve through-hole at a top, the resilient deformation valve has a primary drainage hole at a bottom of a side wall, and a ratio of a diameter of the resilient deformation valve through-hole to a diameter of the primary drainage hole is 4:1.

6. The self-priming starting device for the centrifugal pump according to claim 1, wherein the gas-liquid cutter has a circular cross-section, and a diameter of the gas-liquid cutter gradually decreases from a middle to two ends, the spiral blades on the two ends of the gas-liquid cutter are spiraled in opposite directions, and a distance between adjacent two of the spiral blades gradually increases in a direction from the two ends to the middle of the gas-liquid cutter.

7. The self-priming starting device for the centrifugal pump according to claim 5, wherein a ratio of a diameter of the primary spacer through-hole, a diameter of the secondary spacer through-hole and the diameter of the resilient deformation valve through-hole is 1:1:1.

8. The self-priming starting device for the centrifugal pump according to claim 5, wherein a plurality of impact curved holes are provided on the opening and closing disc near the inner wall of the outer housing, and the impact curved holes are symmetrical two by two with respect to the vertical rod, and the secondary drainage holes are symmetrical two by two with respect to the vertical rod, the impact curved holes, the secondary drainage holes and the primary drainage hole have an equal number, the impact curved holes each are an equidiameter curved hole, the impact curved holes each have an arc of 25°, the impact curved holes each have a diameter that is twice a diameter of each of the secondary drainage holes, and an angle between an axis of a top outlet of each of the impact curved holes and a wall surface of the gas-liquid chamber is 15°.

9. The self-priming starting device for the centrifugal pump according to claim 5, wherein the piston, the gas-liquid cutter, and the resilient deformation valve are made of a rubber material, and the elastic steel plate is made of 45# steel, and the remaining components are formed by processing a graphene material.

* * * * *